United States Patent [19]

Strub

[11] 4,164,249

[45] Aug. 14, 1979

[54] METHOD AND APPARATUS FOR MACHINING COMPONENTS FOR STAIRS

[76] Inventor: Robert D. Strub, 817 S. Capitol, Iowa City, Iowa 52240

[21] Appl. No.: 876,146

[22] Filed: Feb. 8, 1978

[51] Int. Cl.[2] ..... B27C 5/10

[52] U.S. Cl. ..... 144/326 R; 33/454; 144/136 B

[58] Field of Search ..... 33/25 B, 25 C, 79, 79 A, 33/98, 174, 108; 144/136 R, 136 B, 144 R, 144 S, 323, 326 R, 144 A; 90/DIG. 3, 13 R

[56] References Cited

U.S. PATENT DOCUMENTS

| | | | |
|---|---|---|---|
| 650,992 | 6/1900 | Sawyer | 144/144.5 X |
| 827,233 | 7/1906 | Gould | 33/108 |
| 831,204 | 9/1906 | Woolf | 144/144.5 |
| 1,306,252 | 6/1919 | Dauger | 144/136 B |
| 2,645,028 | 7/1953 | Altnether | 33/108 X |

FOREIGN PATENT DOCUMENTS

| | | | |
|---|---|---|---|
| 607905 | 9/1948 | United Kingdom | 144/144.5 |

*Primary Examiner*—Robert Louis Spruill
*Assistant Examiner*—W. Donald Bray
*Attorney, Agent, or Firm*—James C. Nemmers; Haven E. Simmons

[57] ABSTRACT

An apparatus that facilitates the manufacture of wooden stairs of the type having treads and risers extending between and affixed to side housings or stringers. The apparatus provides multiple, parallel guides for the router used to cut the grooves in the stringers into which are fitted the treads and risers. By using a parallelogram construction for the multiple guides, the apparatus can be quickly adjusted and set to produce almost any size of stairs. An index bar used with the apparatus allows the apparatus to be quickly set for the particular stairs desired so that the grooves for both the treads and risers can be cut quickly and accurately in the stringers. The router is moved along each of the parallel guides to cut the grooves for all of the treads, and then the apparatus is quickly and easily reset and locked into position to set the guides for cutting of the grooves for the risers.

7 Claims, 8 Drawing Figures

FIG 2
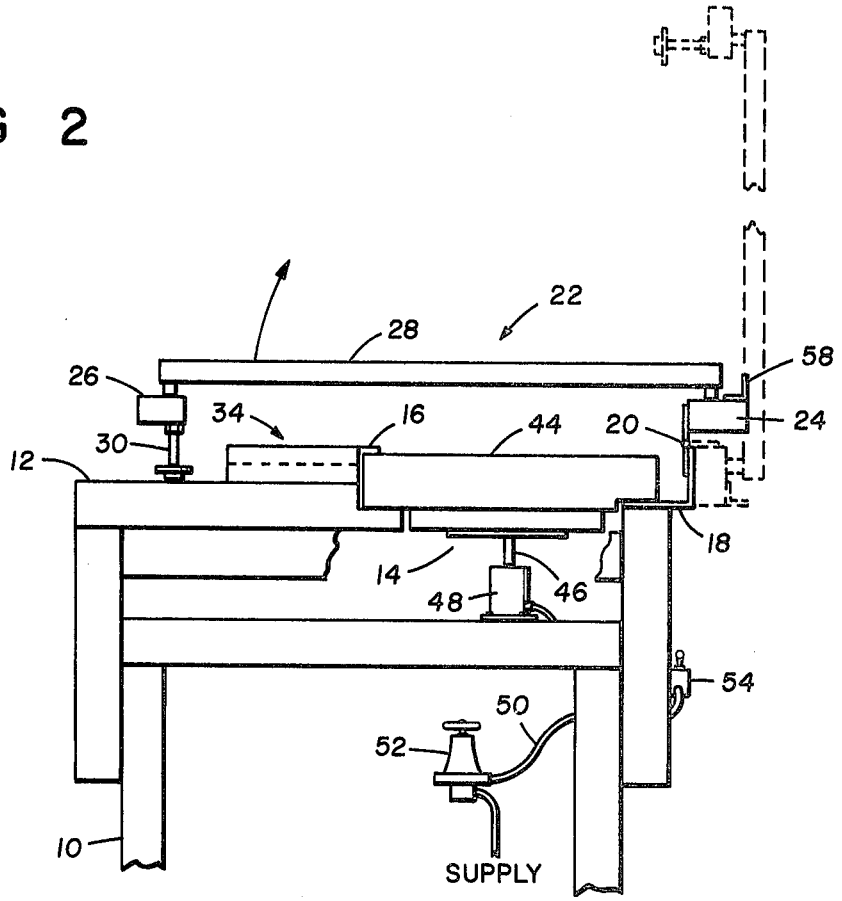
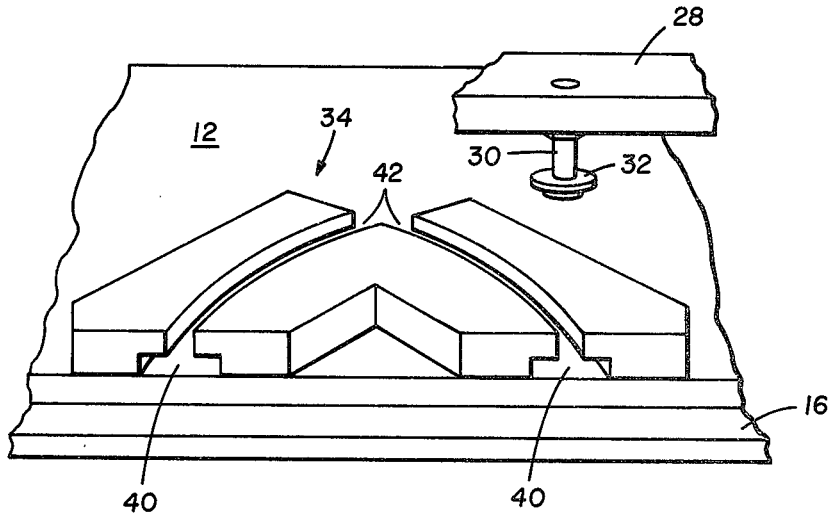
FIG 3

METHOD AND APPARATUS FOR MACHINING COMPONENTS FOR STAIRS

BACKGROUND OF THE INVENTION

Wooden stairs have been used for many, many years on all types of residential and some commerical construction. The standard closed stairs consists of two parallel spaced-apart members, called housings or stringers, which support a sufficient number of treads and risers to span the distance between the two levels for which the stairs are designed. The conventional method of producing the components for the stairs is to use a router and a jig to machine in the stringers each groove for a riser and a tread. There are known and commonly used various jigs and other devices which are designed to assist in locating the grooves in the stringers and to provide a guide for the router used to cut the grooves. However, these jigs and other devices are somewhat complicated and some of them are inconvenient to use. In any event, the carpenter generally has to make some relatively time consuming computations in order to determine both the rise and run of the stairs. In addition, the devices known and presently used will allow the router to cut only a single groove at a time, and then the device or jig has to be moved and properly positioned for the next groove. Moreover, in conventional stairs, the grooves are generally tapered to allow for proper and accurate final positioning of the treads and risers relative to each other with wedges being used to hold the treads and risers in place once they have been properly positioned. As a result, production of stairs even in a manufacturing facility is a slow process and subject to errors. The process is an even slower one where the stairs are constructed on the job site.

In my copending United States patent application, Ser. No. 874,413, filed Feb. 2, 1978, and entitled "Stairs and Method of Making the Same" I have disclosed a stairs construction using interlocking components that eliminate the use of wedges, adhesives and other fastening devices commonly employed in the manufacture of the conventional wooden stairs. The stairs construction disclosed in my said copending United States patent application requires accurate machining for which conventional methods and apparatus are not suitable. In addition, there is not known in the prior art any satisfactory apparatus or method for making the conventional glue-wedge type stairs on even a limited mass production basis. Therefore, the labor as well as material cost for conventional wooden stairs continues to increase. There is therefore a need for a method and apparatus for producing wooden stairs, both conventional and of the interlocking type disclosed in my said copending patent application, that will reduce the labor involved in producing such stairs and thus reduce the cost thereof. The method and apparatus of my invention as described herein greatly reduces the layout, production and assembly time of any wooden stairs and also practically eliminates the possibility of errors in the manufacture of such stairs.

SUMMARY OF THE INVENTION

The apparatus of the invention is a jig that utilizes a plurality of parallel spaced-apart router guide bars which are pivotally mounted at each end to parallel longitudinally extending frame members, one of which is fixed and the other movable relative to it while the guide bars pivot. The parallel spaced-apart guide bars provide guides for a router that is manually moved along each guide bar to cut a groove in a stringer properly positioned beneath the guide bars. An index tool bar set according to the rise and run of the stairs to be produced determines the position of the movable longitudinal member relative to the fixed longitudinal member, thus determining the angle of the parallel spaced-apart guide bars. Once the jig has been set and locked in place, a router can be passed along each of the guide bars to cut the grooves in a stringer for all of the treads. The movable longitudinal member is then swung to a second position in which the guide bars are at a precise right angle to their first position. The router is then passed along each of the guide bars to cut the grooves in the stringer for the risers. The jig has suitable stops so that the grooves are accurately cut to the proper length for the treads and risers. The procedure is repeated for the second stringer, and after the individual threads and risers have been cut to their proper size, the stairs are ready for assembly either at the factory or on the job site.

BRIEF DESCRIPTION OF THE DRAWINGS

FIG. 2 is an end view of the apparatus of FIG. 1;

FIG. 3 is an enlarged view in perspective showing one of the hold down tracks which serve to lock the apparatus in its operational position;

DESCRIPTION OF THE PREFERRED EMBODIMENT OF THE INVENTION

Figure 1:
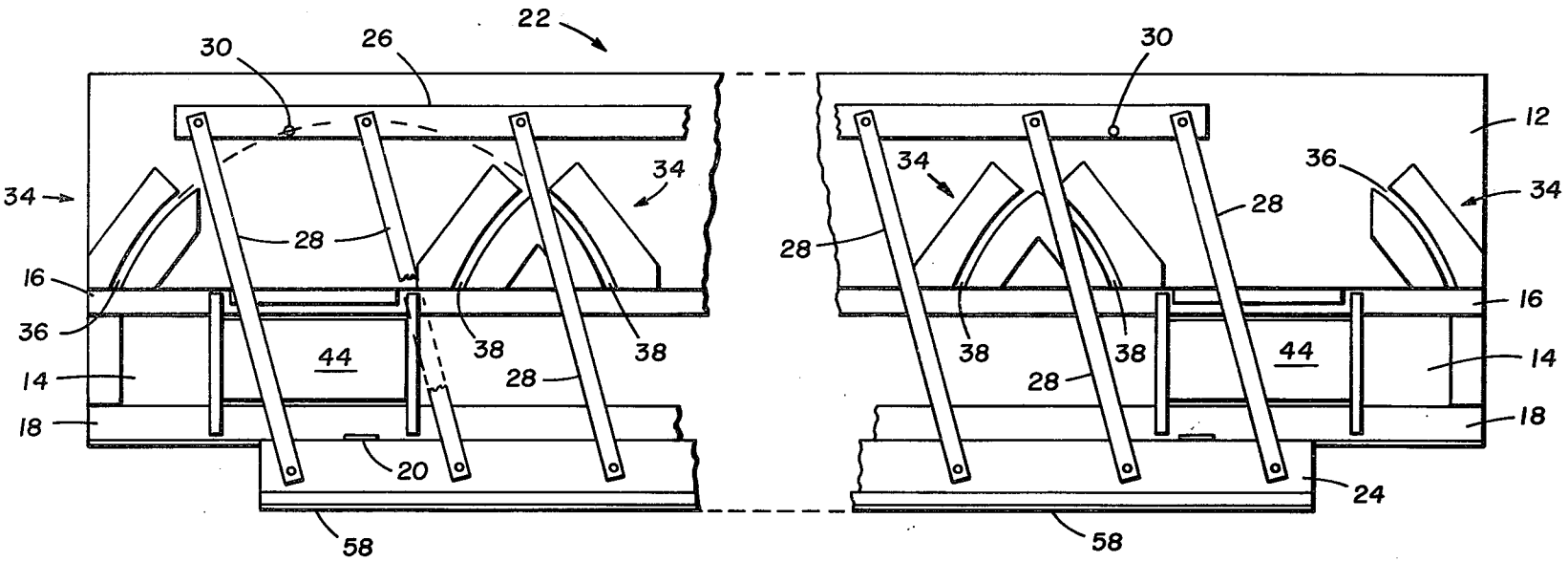
FIG. 1 is a plan view illustrating the apparatus of the invention.

In FIG. 1 there is shown a plan view of a portion of an apparatus constructed according to the principles of the invention. This plan view has the center section broken away, but the center section is merely a repetition of the router guide bars. Usually, there will be fourteen guide bars in a production apparatus. Referring to FIGS. 1 and 2, the apparatus of the invention includes a supporting frame 10 supporting a table 12 that includes a longitudinally extending opening 14 defined by longitudinally extending frame members 16 and 18 which are affixed to the supporting frame 10. Pivotally connected to the longitudinally extending frame member 18 by hinges 20 is a jig indicated generally by the reference numeral 22. Jig 22 consists of a longitudinally extending bar 24 that is affixed by hinges 20 to frame member 18. Jig 22 also includes a second longitudinally extending movable bar 26 that is positioned parallel to and rearwardly of bar 24. Bar 26 has pivotally affixed thereto a plurality of guide bars 28 each of which is also pivotally connected at its other end to bar 26. Guide bars 28 are parallel to each other and equally spaced apart thereby providing a jig 22 that has a parallelogram construction in which the guide bars 28 can be moved to an infinite number of angular positions merely by moving the movable bar 26. Each guide bar 28 is a rigid member the sides of which provide an accurate guide for a router 25 (FIG. 7) in the manner described hereinafter.

To assist in positioning and guiding the jig 22 and also to assist in locking it in place once the desired position of guide bars 28 has been selected, there is affixed to the movable bar 26 and extending downwardly therefrom one or more guide pins 30 each of which has affixed near its outer end a locking collar 32. Affixed to the table 12 beneath the jig 22 and rearwardly of the opening 14 are a plurality of hold down tracks each indicated generally by the reference number 34. The two tracks 34 at the outer ends of the apparatus have a single slot 36 while the other hold down track 34 have dual slots each of which is indicated by the reference numeral 38. The slots 36 and 38 are curved on an arc defined by the radius and center of curvature of the position of the corresponding guide pin 30 so as to receive the guide pins 30 as the bar 26 is moved from side to side. As best seen in FIG. 3, the hold down tracks 34 are each formed by a projectin 42 extending inwardly on each side so as to provide a slotted track 40. The slots 36 and 38 formed between the projections 42 are each of a width at least as great as the diameter of the corresponding guide pins 30. Thus, as the movable bar 26 is swung through its path as limited by the pivotal connections with the guide bars 28, the guide pins 30 will engage in the corresponding guide slots 36 and 38 with the locking collars 32 riding in tracks 40 beneath the projections 42. When so engaged, the collars 32 prevent the jig 22 from being swung upwardly about hinges 20.

At spaced locations along the frame members 16 and 18 there are positioned in the opening 14 vertically movable stringer supports and locking members 44. Each of the stringer supports 44 rests upon the operating rod 46 of an air or hydraulic cylinder 48 that is supported by and affixed to the frame 10. The stringer supports 44 float on the ends of the operating rods 46 so as to provide for free movement and allow the supports 44 to conform to the stringer being machined. Each of the cylinders 48 is connected to a supply line 50 which is connected through a pressure control valve 52 to a supply of fluid pressure (not shown). To supply fluid pressure to cylinders 48, the machine operator actuates pressure switch 54 positioned on the front of the support frame 10.

Figure 5:
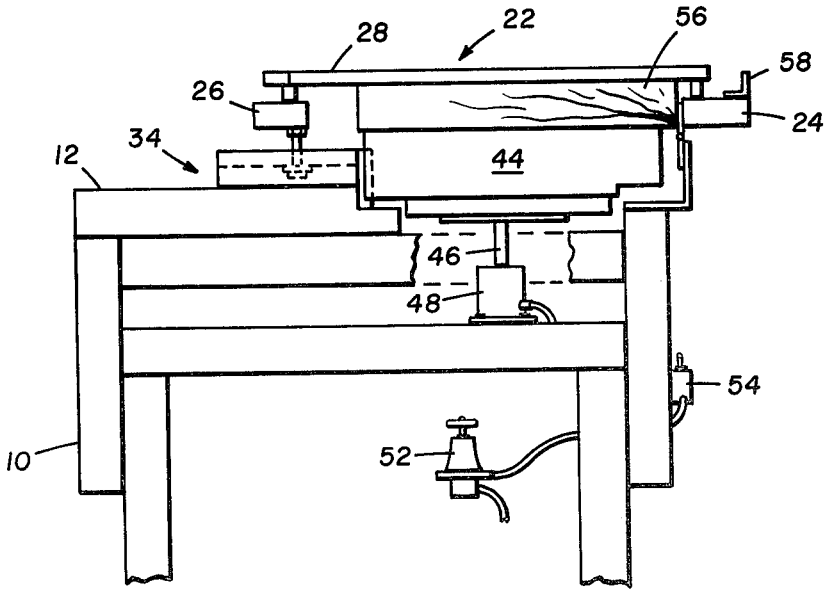
FIG. 5 is an end view of the apparatus of FIG. 4 showing a stringer locked in position and with the index tool bar removed.

Referring now to FIG. 5, a wooden stringer 56 for the stairs is shown in position ready to be machined. Stringer 56 is supported on the stringer supports 44, and with the jig 22 properly positioned in the manner described hereinafter with the locking collar 32 of each guide pin 30 engaged in the corresponding tracks 40, the switch 54 is actuated to supply pressure fluid to the cylinders 48. This in turn moves the operating rods 46 and stringer supports 44 upwardly forcing the stringer 56 against the bottom surfaces of the guide bars 28. This in turn forces the entire jig 22 upwardly so that the locking collars 32 are forced against the bottom of the projections 42 thereby locking both the stringer 56 and jig 22 in place. In FIG. 5, note that the longitudinal edge of the stringer 56 rests tightly against the inside edge of the bar 24 which serves to properly position the stringer for machining. Also, as best seen in FIG. 5, a stop 58 in the form of an angle iron is affixed along the top outer edge of the bar 24 to serve as a stop for the router 25 in the manner described hereinafter.

Figure 7:
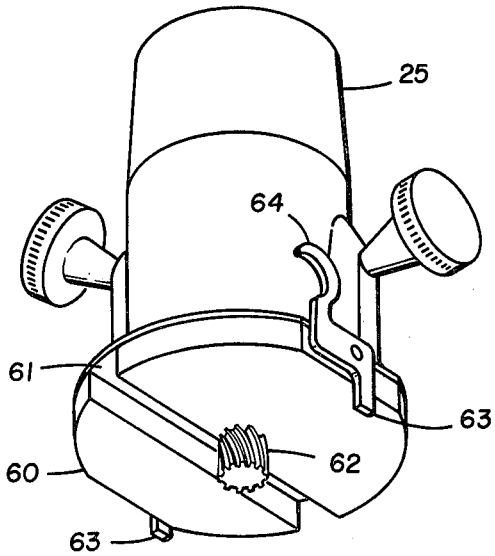
FIG. 7 is a perspective view of a router and showing the base plate adapted for use in connection with the apparatus of the invention.

Referring now to FIG. 7 there is shown router 25 with a base plate 60 affixed to it to serve as a guide. Base plate 60 has formed therein a guide slot 61 the width of which is slightly greater than the width of each guide bar 28. The cutting tool 62 extends through the guide plate 60 and pivotally mounted stops 63 extend below the bottom surface of base plate 60. Finger-operated triggers 64 serve to depress stops 63 which are normally biased upwardly above the bottom surface of base plate 60.

Figure 4:
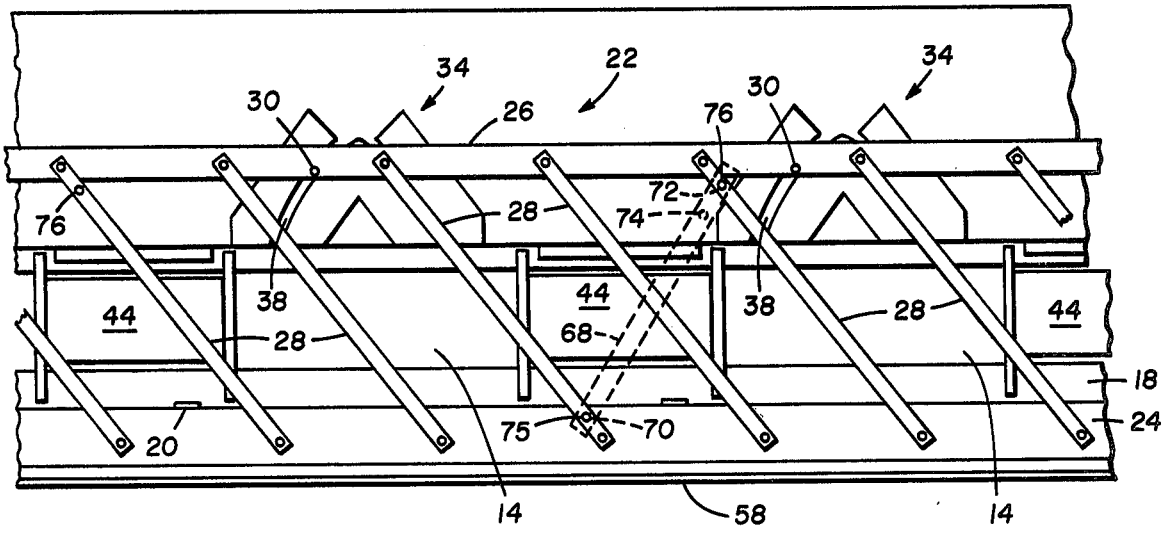
FIG. 4 is a plan view of a portion of the apparatus showing the apparatus in a locked position with the index tool bar in place.
Figure 6:
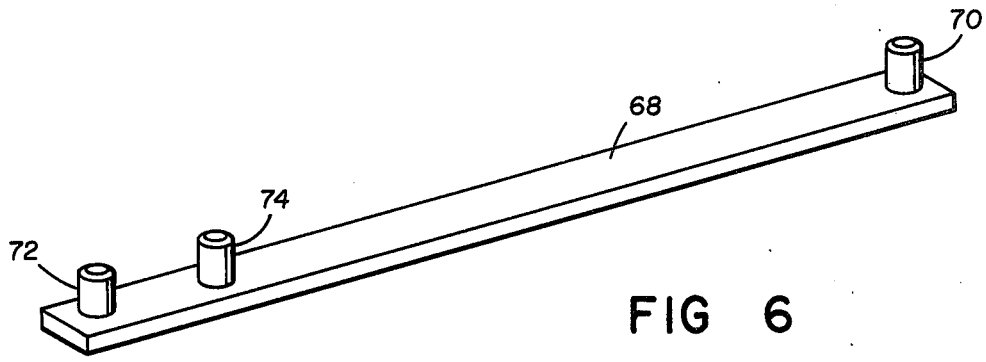
FIG. 6 is a perspective view of the index tool bar used in connection with the apparatus and invention.

In FIG. 6, there is shown in perspective an index tool 68 bar which serves to properly position the jig 22 for machining the stringers for the stairs of the desired size. Tool bar 68 has depending from it three locating pins 70, 72 and 74. Pin 70 is a positioning pin 70 while pin 72 is in the "rise" pin and 74 the "run" pin. As shown in FIG. 4, one of the guide bars 28 has a hole 75 extending through it near the forward end. Two other guide bars 28 each have a similar hole 76 formed near its rearward end, these two guide bars 28 being the second guide bar to the left and the second guide bar to the right of guide bar 28 that has hole 75. The diameter of each of the holes 75 and 76 corresponds to the diameter of the pins 70, 72 and 74. The distance between the positioning pin 70 and the rise pin 72 as well as the distance between the positioning pin 70 and the run pin 74 are critical and have been determined empirically. The function of the tool bar 68 will be evident from the operation of the apparatus which will now be described.

Before the stairs can be produced, the height to be spanned by the stairs must be known. Also, the amount of rise desired must be known. Generally, there are building code limitations on the amount of rise and also on the run and the length of the nose on each tread. By dividing the total distance between the two levels to be spanned by the rise, the number of risers can be determined. A stringer 56 of the appropriate length is then selected and placed in position on the table 12 above the opening 14 with the top edge of the stringer abutting against the inside edge of the bar 24. Of course, in order to facilitate placement of the stringer 56 on the table 12, the jig 22 is pivoted upwardly to the position shown by dotted lines in FIG. 2. The jig 22 is then swung downwardly and the guide pins 30 moved into the slots 36 and 38 with the locking collars 32 engaged beneath the projections 42. The appropriate index tool bar 68 is then selected for the rise of the stairs to be constructed. The positioning pin 70 is inserted into the forward hole 75 of one of the guide bars 28. The rise pin 72 is then inserted into the rear hole 76 of the second guide bar 28 to the right of the guide bar 28 into which the positioning pin 70 has been inserted. This is illustrated in FIG. 4. This then locks the jig 22 in a fixed position. With the stringer 56 properly positioned with its top edge abutting the inside edge of the bar 24, the switch 54 is manually moved to the "lock" position which applies fluid pressure to the cylinder 48 thus moving the stringer supports 44 upwardly and pressing the stringer 56 tightly against the underside of the guide bars 28. This also forces each of the locking collars 32 tightly against the underside of projections 42 also locking the jig 22 in position. The index tool bar 68 can then be removed. Router 25 of any suitable design but having affixed to it the guide plate 60 (FIG. 7) is positioned at the rearward end of one of the guide bars 28 with the guide bar 28 engaged in slot 61. With the cutting tool 62 being driven, the router 25 is then moved forwardly along the guide bar 28 until the forward edge of the guide plate 60 strikes the stop 58. The router 25 is then removed from the guide bar 28 by backing it through the groove formed in striner 56, particularly if the groove is a dovetail. The router 25 is then placed on the next guide bar 28 and the process repeated until a groove has been machined in the stringer 56 for each of the treads necessary to complete the particular stairs.

With all of the tread grooves formed in the stringer 56, the switch 54 is moved to the "unlock" position which releases the fluid pressure in cylinder 48 which in turn releases the pressure of the stringer 56 applied to the jig 22 thus allowing the jig 22 to be freely moved. The jig 22 is then swung toward the right (FIGS. 1 and 4) by moving the movable bar 26 until the guide pins 30 are engaged in the slots 36 and 38 of the corresponding hold down track 34. The index tool bar 68 is then positioned on jig 22 with the positioning pin 70 engaged in the forward hole 75 and with the run pin 74 engaged in the rear hole 76 of the second guide bar 28 to the left of the guide bar 28 that is engaged with the positioning pin 70. The jig 22 is then locked in position for cutting of the grooves for the risers. With the stringer 56 properly positioned with its top edge against the inside edge of bar 24, the switch 54 is moved to a lock position which again forces stringer 56 upwardly and applies pressure to the underside of guide bars 28 and forces locking collar 32 against projections 42 of the hold down tracks 34. With the jig 22 now locked in position, the index tool bar 68 is removed. The router 25 containing guide plate 60 is then passed along each of the guide bars 28 moving the router 25 from its rearmost position forwardly until the operator moves stops 63 on base plate 60 downwardly to strike the side of the already formed tread groove thus preventing the router from cutting the groove beyond the tread groove. The procedure is repeated until all of the necessary riser grooves are formed in the stringer 56 at which time switch 54 is moved to the unlock positioned releasing the pressure on stringer 56 and upon jig 22. The jig 22 can then be swung upwardly and the machined stringer removed from the apparatus.

Figure 8:
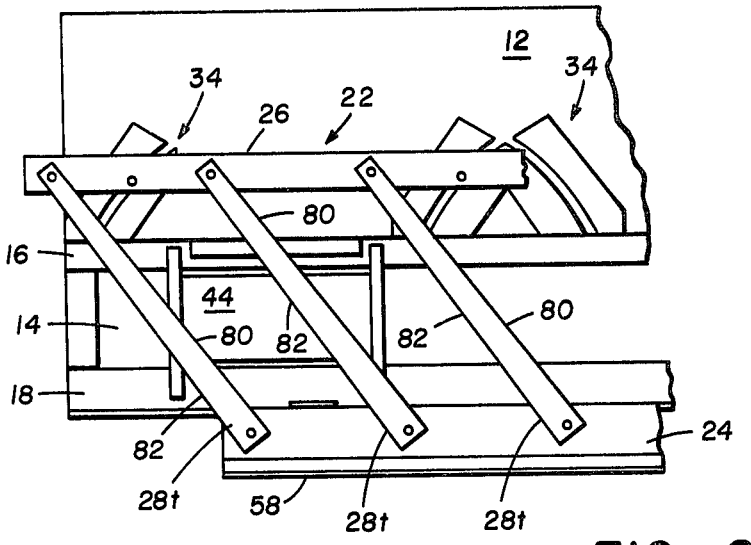
FIG. 8 is a plan view of a portion of a modified embodiment of the invention for machining stringers for a glue-wedge type stairs.

Referring now to FIG. 8, a modified form of the apparatus is shown for machining in the stringers the tapered grooves for a glue-wedge type stairs. The components of the modified apparatus of FIG. 8 are identical to those of the first embodiment except that the guide bars **28*t* are tapered with the wider end of each guide bar 28*t* being pivotally connected to longitudinally extending bar 24. With the modified apparatus of FIG. 8, the width of the slot 61 in the guide plate 60 of router 25 would be at least as great as the widest portion of guide bars 28*t*. With this construction the procedures for and operation of machining a stringer 56 is the same as the first embodiment in which the guide bars 28 have parallel sides. However, as the router 25 is moved forwardly from the narrower end toward the wider end of the tapered guide bar 28*t*, the rotation of the cutting bit or tool 62 will force the side of slot 61 against the edge 80 of the guide bar 28*t*. Then, when the router 25 is moved in the opposite direction, the opposite side of the slot 61 will be forced against the edge 82 of guide bar 28*t* thus producing a groove in the stringer that is tapered with the wider portion of the groove at the rear. If the width of slot 61 is greater than the wider end of guide bar 28*t*, the nose formed in the groove as the router 25 is reversed will be wider to receive a tread of a greater thickness. Thus, by merely changing the base plate 60 on the router 25, stringers for stairs of the glue-wedge type can be produced to receive treads of any desired thickness while still using the same guide bars 28*t***.

Using the foregoing described apparatus and method of the invention, the stringers can be accurately and quickly machined. If dovetail grooves are to be machined in the stringers in order to produce interlocking stairs of the type disclosed and claimed in my above identified United States Patent Application, Ser. No. 874,413, warpage or other distortion in the wooden stringers does not affect the precise fit in machining of the components for the stairs. The guide bars 28 are rigid, and if there is distortion or warpage in a stringer, the grooves cut into the stringer will be straight and the bottom of each groove will be perfectly straight and flat even though the stringer is warped. Thus, when the interlocking treads and risers are inserted in the grooves, they will slide in with ease. Obviously, once the jig 22 is locked into its selected position, the spacing of the treads and spacing of the risers and their relative position are accurately and precisely machined. If the proper index tool bar 68 is selected, there is almost no chance for error. This is especially important when stairs are to be produced using the interlocking design disclosed and claimed in my said copending patent application. However, even where conventional glue-wedge stairs are to be produced, it is evident that the ease of my novel method and apparatus greatly reduces the layout and setup time for making the tapered grooves. The method and apparatus of the invention therefore are useful in all types of wooden stairs, and because use of my novel method and apparatus greatly reduces the labor involved, the cost of producing stairs using my invention can be substantially reduced.

In addition to using the index tool bar 68, there are other means that can be employed to set the machine for the rise and run desired for a particular stairs. For example, an index could be combined with the hold down tracks 34 so that an indicator on the movable bar 26 could be set on the selected marking on the track 34. Also, adjustable stops could be combined with the apparatus to limit movement of the jig 22 to a predetermined set position according to the rise and run of the stairs to be produced.

Also, a single portable jig could be constructed using only a few guide bar with the rise and run being determined by use of an index tool bar or by conventional methods using a measuring tape and square or other device to determine a right angle. Such conventional method could especially be used with the simplified portable jig of the invention for producing a glue-wedge type stairs on the job site.

Therefore, although my invention has been described in connection with preferred embodiments thereof, it will be obvious to those skilled in the art that various revisions and modifications can be made in both the method and apparatus of the preferred embodiment without departing from the spirit and scope of the invention. It is my intention however that all such revisions and modifications as are obvious to those skilled in the art will be included within the scope of the following claims.

I claim:

1. An apparatus for aiding the machining of grooves in stringers for stairs which grooves receive treads and risers therein when said stairs are assembled, said apparatus comprising support means for the stringer being machined, a first longitudinally extending member fixed to said supporting means, a second longitudinally extending member parallel to said first member and movable relative thereto, a plurality of spaced-apart guide members to guide a tool for machining said grooves, each of said guide members being pivotally connected at one end to said first member and at the other end to said second member, the distance between the pivotal connections of adjacent guide members to said first member being equal to the distance between the pivotal connections of said same adjacent guide members to said second member, said second member being movable relative to said first member while maintaining their parallel relationship as said guide members pivot, and means for maintaining said guide members in a selected position during the machining operation including locking means having a first portion affixed to said second member and a second portion affixed to said support means, said first and second portions being engagable in a plurality of selected positions to prevent pivotal movement of said guide members.

2. The apparatus of claim 1 in which power means is associated with said support means to force a stringer resting on said support means upwardly against said guide members and to lock said first and second portions of said locking means.

3. The apparatus of claim 2 in which said first longitudinally extending member is pivotally connected about a horizontal axis to the supporting means so that when said locking means is unlocked, said first member and the guide members and second member connected thereto can be swung upwardly to facilitate placement and removal of a stringer on said support means.

4. The apparatus of claims 1, 2 or 3 in which each of said guide members is a relatively narrow bar having parallel sides.

5. The apparatus of claim 1, 2 or 3 in which each of said guide members is a bar having straight non-parallel sides converging from a wide end toward a narrow end.

6. The apparatus of claims 1, 2 or 3 in which the spacing of the pivotal connections of all of said guide members are equal.

7. The method of machining grooves in stringers for stairs which grooves are adapted to receive the ends of treads and risers therein when said stairs are assembled, said method comprising: providing a jig having a plurality of parallel spaced-apart guide members corresponding to the number of treads in the stairs; positioning said jig with said guide members over the surface of the stringer into which said grooves are to be machined; moving said guide members to a first position in which they are at the desired angle relative to said stringer; locking said guide members in position relative to said stringer; passing a tool along each of said guide members to form the grooves for said treads in said stringer; unlocking said guide members so that they can be moved relative to said stringer; moving said guide members to a second position in which they are at right angles to their first position; locking said guide members in said second position relative to said stringers; passing said tool along each of said guide members to form the grooves for said risers in said stringer; and unlocking said guide members so as to allow said machined stringer to be removed from beneath said jig.

* * * * *